US006912783B2

(12) United States Patent
Tanaka et al.

(10) Patent No.: US 6,912,783 B2
(45) Date of Patent: Jul. 5, 2005

(54) METHOD OF MANUFACTURING A VALVE PLATE FOR COMPRESSOR

(75) Inventors: Hirohiko Tanaka, Aichi (JP); Suguru Hirota, Aichi (JP); Atsushi Shibata, Aichi (JP); Takeshi Kondo, Aichi (JP); Mitsuru Hattori, Aichi (JP); Eiji Tokunaga, Aichi (JP); Tetsuhiko Fukanuma, Aichi (JP); Masakazu Hashimoto, Aichi (JP); Hiromi Yoshino, Aichi (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 0 days.

(21) Appl. No.: 10/240,355

(22) PCT Filed: Feb. 19, 2002

(86) PCT No.: PCT/JP02/01424

§ 371 (c)(1),
(2), (4) Date: Mar. 18, 2003

(87) PCT Pub. No.: WO02/066832

PCT Pub. Date: Aug. 29, 2002

(65) Prior Publication Data

US 2003/0163919 A1 Sep. 4, 2003

(30) Foreign Application Priority Data

Feb. 19, 2001 (JP) ..... 2001-41878

(51) Int. Cl.[7] ..... B23P 15/00; B21D 13/00

(52) U.S. Cl. ..... 29/888.02; 29/890.13; 72/379.6; 72/703

(58) Field of Search ..... 29/888.02, 557, 29/888.022, 890.132, 890.12; 72/53, 379.2, 379.6, 703

(56) References Cited

U.S. PATENT DOCUMENTS

| | | | | | |
|---|---|---|---|---|---|
| 2,151,746 | A | * | 3/1939 | Cody | 137/512.1 |
| 4,911,614 | A | * | 3/1990 | Kawai et al. | 417/269 |
| 4,976,284 | A | * | 12/1990 | Hovarter | 137/512.4 |
| 5,074,768 | A | | 12/1991 | Kawamura et al. | 417/571 |
| 5,078,582 | A | | 1/1992 | Ohbayashi et al. | 417/571 |
| 5,871,337 | A | | 2/1999 | Fukanuma et al. | 417/222.2 |
| 6,162,026 | A | * | 12/2000 | Kimura et al. | 417/222.2 |
| 6,186,048 | B1 | * | 2/2001 | Kimura et al. | 92/71 |
| 6,283,722 | B1 | * | 9/2001 | Takenaka et al. | 417/222.2 |
| 2003/0007877 | A1 | * | 1/2003 | Kurita et al. | 417/222.1 |

FOREIGN PATENT DOCUMENTS

| | | | |
|---|---|---|---|
| EP | 0 962 655 A2 | 12/1999 | F04B/39/10 |
| EP | 1 054 157 A2 | 11/2000 | F04B/39/10 |
| GB | 26522 | 11/1911 | |
| GB | 1075346 | 7/1967 | A62B/17/02 |
| JP | 2-218875 | 8/1990 | F04B/27/08 |
| JP | 7-174071 | 7/1995 | F04B/27/08 |

* cited by examiner

*Primary Examiner*—Marc Jimenez
(74) *Attorney, Agent, or Firm*—Morgan & Finnegan, LLP

(57) ABSTRACT

In a manufacturing method of a valve plate for a compressor according to this invention, a punch die 43 formed with a convex and concave configuration at its tip end face 42 is set at a press machine 41, and the punch die 43 is depressed against a surface of a valve plate 9 to transfer the convex and concave configuration of the tip end face 42. Thus, peripheral portions of a suction port and a discharge port of the valve plate 9 are roughened.

4 Claims, 6 Drawing Sheets

METHOD OF MANUFACTURING A VALVE PLATE FOR COMPRESSOR

TECHNICAL FIELD

The present invention relates to a method of manufacturing a valve plate for a compressor, and more particularly to a method of processing surfaces around suction ports and discharge ports of a valve plate.

BACKGROUND ART

In general, in a piston type compressor such as a swash plate type compressor, cylinder blocks and a set of a suction chamber and a discharge chamber are defined while intervening a valve plate therebetween. In the valve plate, suction ports are formed in positions leading to the suction chamber and discharge ports are formed in positions leading to the discharge chamber. Then, a suction valve is disposed on a surface of the valve plate on the cylinder block side and a discharge valve is disposed on the other surface thereof on the side of the suction chamber and discharge chamber. The suction valve has suction reed portions at positions corresponding to the suction ports, and the discharge valve has discharge reed portions at positions corresponding to the discharge ports.

During the operation of such a compressor, the suction reed portions of the suction valve and the discharge reed portions of the discharge valve are adapted to open and close the suction ports and the discharge ports of the valve plate in accordance with the reciprocating motion of pistons. However, these reed portions are brought into tight contact with the surface of the valve plate due to the surface tension since lubricant component contained in a refrigerant adheres thereto. Accordingly, it is known that an instantaneous pressure variation is generated during the opening/closing operation of the suction ports and the discharge ports, thus inducing generation of an abnormal sound from an evaporator connected to the compressor, or exacerbating the noise and vibration caused accompanying collision of the reed portions.

Accordingly, in Japanese Patent Non-Examined Publication (Kokai) No. 2-218875 filed by the present applicant, it is proposed to realize quietness of the operation by roughening the surface of the valve plate with which the suction valve and the discharge valve are to be brought into contact.

It is possible to suppress the generation of the noise and vibration in the opening/closing operation of the suction valve and the discharge valve by such roughening of the surface of a valve plate. Conventionally, a shot blast method of blasting shot grains made by alumina and so on with air pressure has been used to roughen the surface. After the shot grains are blasted onto the surface of the valve plate which are masked in a predetermined pattern, the surface of the valve plate is cleaned.

However, there is a risk that, even if it is cleaned, process scraps produced during the roughening operation or the shot grains per se would remain as foreign matter on the surface of the valve plate. If such foreign matter intrudes into the compressor, operation failure or breakdown of the compressor would be caused as a result.

DISCLOSURE OF THE INVENTION

In order to overcome such a problem, an object of the present invention is to provide a method of manufacturing a valve plate for a compressor, which may perform the roughening of the surface without leaving any residual foreign matter.

A method of manufacturing a valve plate for a compressor according to the present invention comprises the steps of: forming in the plate at least one suction port and at least one discharge port; and pressing a punch die with a tip end face of a convex and concave configuration against at least one of a peripheral portion of each suction port with which a reed portion of a suction valve is brought into contact and a peripheral portion of each discharge port with which a reed portion of a discharge valve is brought into contact so that the configuration of the tip end face is transferred onto the plate surface to perform roughening thereof.

Incidentally, the configuration of the tip end face of the punch die may be transferred to peripheral portions of both the suction port and the discharge port.

Also, the formation of the suction port and the discharge port and the roughening of the peripheral portions thereof may be performed by a common press machining.

It is preferable that a projecting portion is projected and formed at a peripheral edge of the concave portion transferred to the plate by pressing the punch die, a height of the return portion is in the range of 10 to 50 $\mu$m, and a depth of the concave portion is in the range of 50 to 250 $\mu$m.

Furthermore, it is preferable that the plate is made of Fe material having a hardness Hv of 90 to 200.

BEST MODE FOR CARRYING OUT THE INVENTION

Embodiments of this invention will now be described with reference to the accompanying drawings.

Figure 1:
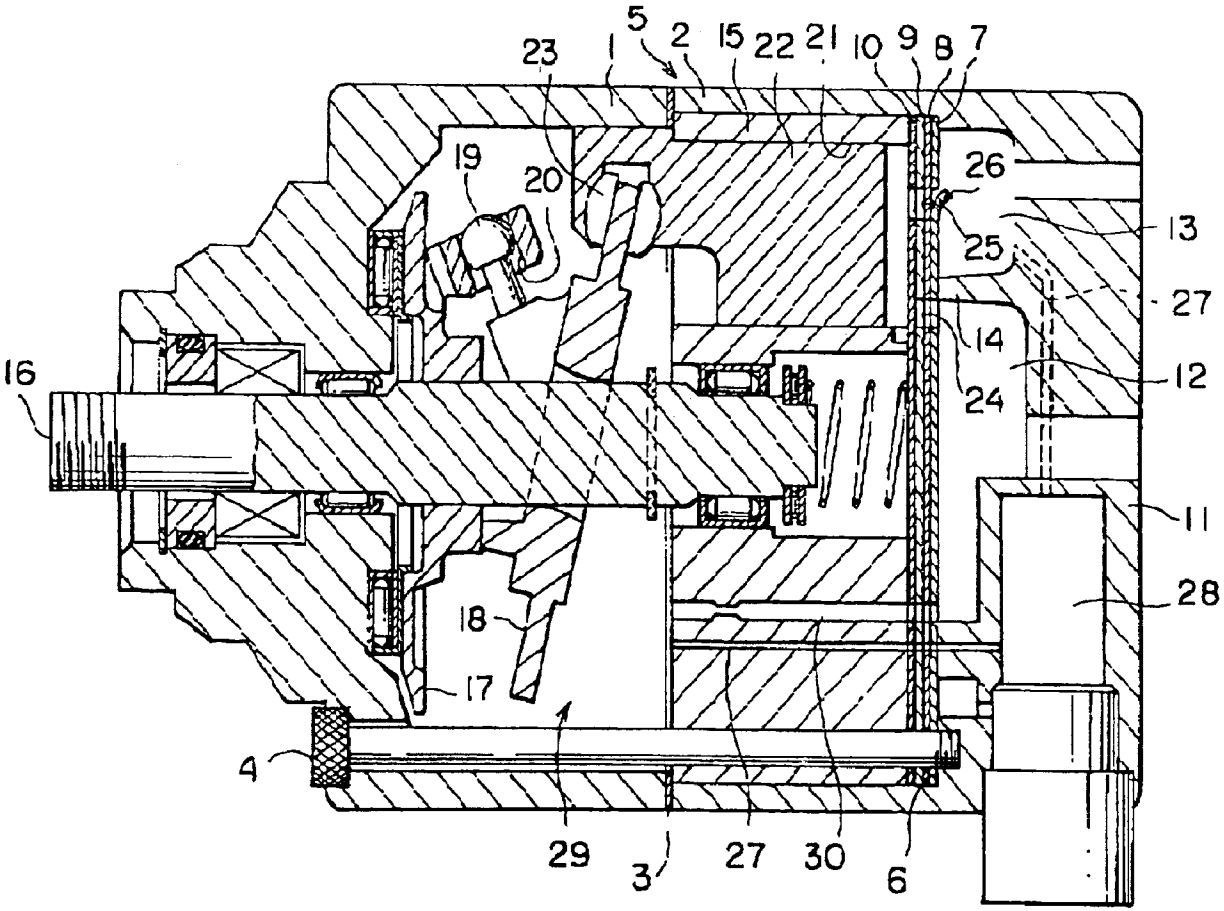
FIG. 1 is a cross-sectional view showing a structure of a swash plate type variable displacement compressor into which a valve plate manufactured in accordance with a manufacturing method of an embodiment of this invention has been incorporated.

FIG. 1 shows a structure of a swash plate type variable displacement compressor into which a valve plate manufactured in accordance with a manufacturing method of an embodiment of this invention has been incorporated.

A front housing 1 and a rear housing 2 are fastened together by means of bolts 4 under the condition that they are coupled with each other through a gasket 3 to thereby form a housing assembly 5. A stepped portion 6 is formed within the rear housing 2. A retainer forming plate 7, a discharge valve forming plate 8, a valve plate 9 and a suction valve forming plate 10 are fitted so as to be jointed to this stepped portion 6. A suction chamber 12 and a discharge chamber 13 are defined between the retainer forming plate 7 and a rear end wall portion 11 of the rear housing 2 so as to be apart from each other through a partitioning wall 14.

Also, a cylinder block 15 is fitted within the rear housing 2 so as to be jointed to the valve forming plate 10. A drive shaft 16 is rotatably supported by the cylinder block and the front housing 1. One end of the drive shaft 16 projects from the front housing 1 to the outside for being connected to unillustrated rotational drive source such as an automotive engine or a motor or the like. A rotary support member 17 is fixed to the rotary shaft 16 within the front housing 1 and a swash plate 18 is disposed so as to be engaged with the rotary support member 17. A guide pin 19 projecting from the swash plate 18 is slidably fitted into a guide hole 20 formed in the rotary support member 17. The swash plate 18 is rotated together with the rotary shaft 16 by means of the engagement of the guide pin 19 with the guide hole 20 under the condition that the rotary shaft 16 passes through a through-hole formed in the central portion of the swash plate 18, and the swash plate 18 is supported so as to slide and tilt in the axial direction of the rotary shaft 16.

A plurality of cylinder bores 21 are arranged around the drive shaft 16 in the cylinder block 15. A piston 22 is slidably received in each cylinder bore 21. Each piston 22 is engaged with an outer circumferential portion of the swash plate 18 through shoes 23. When the swash plate 18 rotates together with the drive shaft 16, each piston 22 performs reciprocating motion through the shoe 23 in the axial direction of the rotary shaft 16 within the cylinder bore 21.

The refrigerant in the suction chamber 12 flows into the cylinder bore 21 after passing through the suction port 24 of the valve plate 9 and then pushing the suction reed portion of the valve plate 10 in accordance with the return motion of the piston 22, i.e., the rearward movement thereof within the cylinder bore 21. This refrigerant is discharged to the discharge chamber 13 after passing through the discharge port 25 of the valve plate 9 and then pushing the discharge reed portion of the valve forming plate 8 in accordance with the subsequent advance motion of the piston 22, i.e., the forward movement thereof within the cylinder bore 21. At this time, the opening degree of the discharge reed portion of the discharge valve forming plate 8 is restricted by contacting with a retainer 26 of the retainer forming plate 7.

The discharge chamber 13 is in communication with a control pressure chamber 29 formed in the interior of the front housing 1 through a passage 27 and a displacement control valve 28, and the control pressure chamber 29 is in communication with the suction chamber 12 through a passage 30. When the displacement control valve 28 is opened, the refrigerant within the discharge chamber 13 is introduced into the control pressure chamber 29 through the passage 27 and the displacement control valve 28 to thereby increase the pressure within the control pressure chamber 29. Incidentally, the inclination angle of the swash plate 18 varies in accordance with the pressure within the control pressure chamber 29. The inclination of the swash plate 18 decreases when the pressure within the control pressure chamber 29 increases, and increases when the pressure within the control pressure chamber 29 decreases. Namely, the inclination angle of the swash plate 18 may be controlled by operating the displacement control valve 28.

Figure 2:
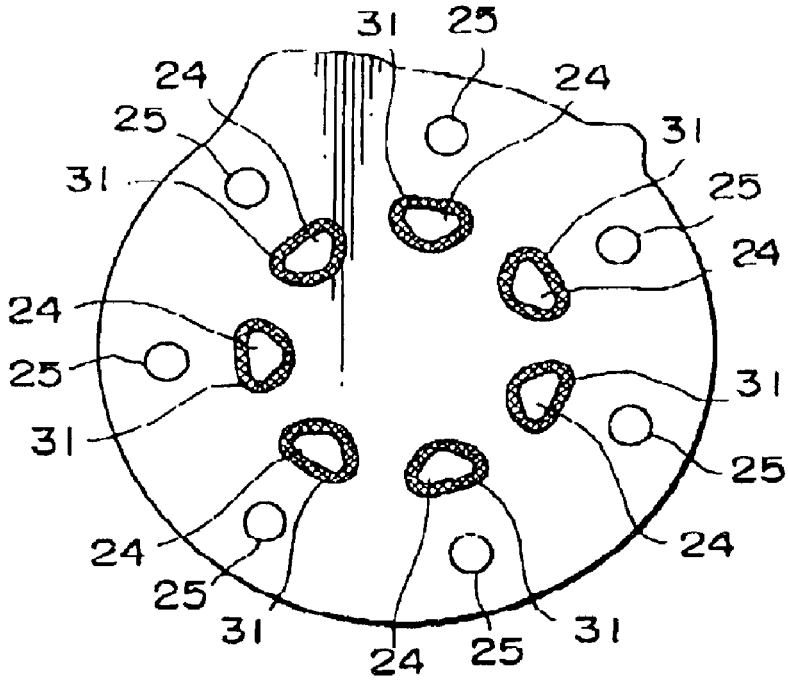
FIG. 2 is a plan view showing the valve plate manufactured in accordance with the manufacturing method of the embodiment.

Although only one cylinder bore 21 and one piston 22 are shown in FIG. 1, this compressor is actually provided with seven cylinder bores 21 and seven pistons 22. For this reason, as shown in FIG. 2, seven suction ports 24 are formed at an equal interval on one circumference of the valve plate 9 and seven discharge ports 25 are formed at an equal interval on the outer side of these suction ports 24.

Figure 3:
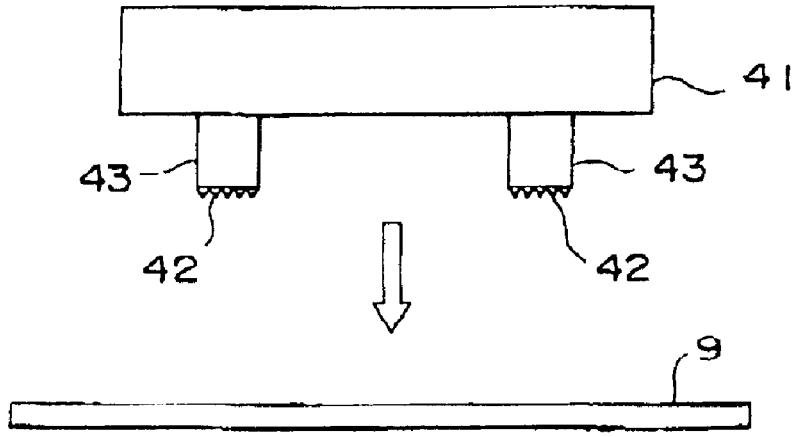
FIG. 3 is a view showing the manufacturing method of the valve plate.

Each suction port 24 is opened in the form of a substantially triangular shape, and a roughened region 31 is formed on the peripheral portion of each suction port 24 so as to fit with the shape of this opening. As shown in FIG. 3, the roughened region 31 is formed by setting on a press machine 41 a punch die 43 with a tip end face 42 formed into a convex and concave array and then pressing the punch die 43 against the surface of the valve plate 9 to transfer thereto the convex and concave configuration of the tip end face 42.

Figure 4A:
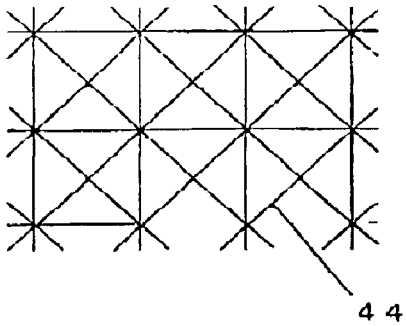
FIGS. 4A and 4B are a plan view and a cross-sectional view showing a tip end face of a punch die used in the embodiment, respectively.
Figure 4B:
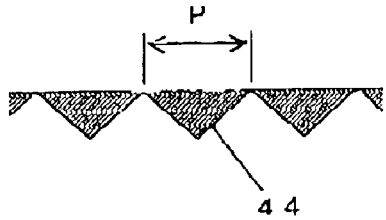
Figure 5:
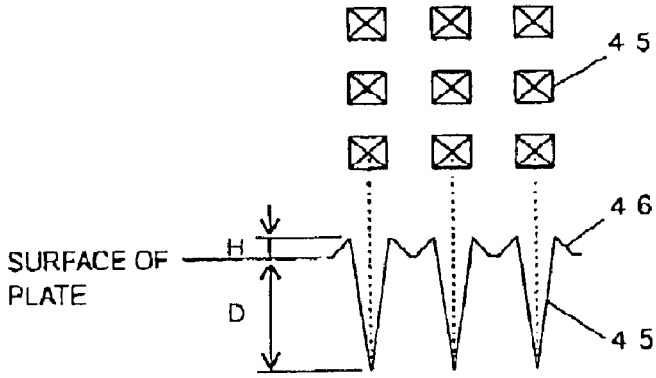
FIG. 5 is an enlarged view showing a roughened region of the valve plate made in accordance with the embodiment.

For example, as shown in FIGS. 4A and 4B, a number of fine pyramid-shaped convex portions 44 arranged at a pitch P are formed on the tip end face 42 of the punch die 43. The punch die 43 is pressed to the surface of the valve plate 9 so that a number of concave portions 45 as shown in FIG. 5 are formed and arranged thereon at the pitch P and projecting portions 46 are projected and formed at a peripheral edge of each concave portion 45.

The concave portions 45 formed in the roughened region 31 form spaces for containing lubricant oil that no longer escapes therefrom when the suction reed portion of the valve forming plate 10 is brought into contact with the peripheral portion of the suction port 24, whereas the return portions 46 serve to reduce the contact area of the valve plate 9 and the suction reed portion. The separating performance of the suction reed portion may be enhanced while the sealing performance is maintained by these concave portions 45 and the return portions 46.

Figure 6:
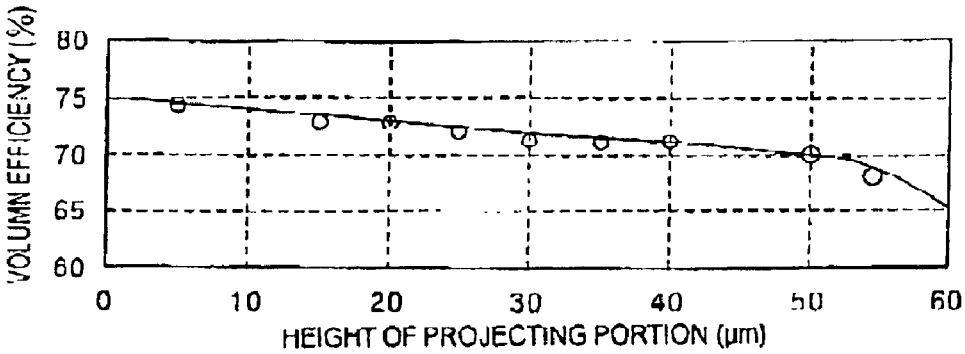
FIGS. 6 and 7 are graphs showing relationships of a volume efficiency and a pulsation to a height of a projecting portion of a valve plate, respectively.
Figure 7:
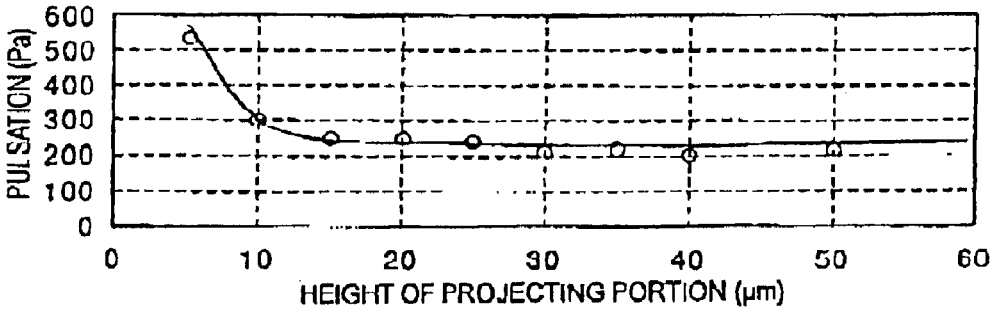

When the respective valve plates 9 were manufactured by changing the height H of the return portions 46 in accordance with the embodiment, and the volume efficiency and the pulsation of the compressor into which each valve plate 9 had been incorporated were measured, the results shown in FIGS. 6 and 7 were obtained. From the results, it was found that it is preferable that, if the height H of the return portions 46 is in the range of 10 to 50 $\mu$m, the volume efficiency be 70% or more and the pulsation be not greater than 300 Pa.

Figure 8:
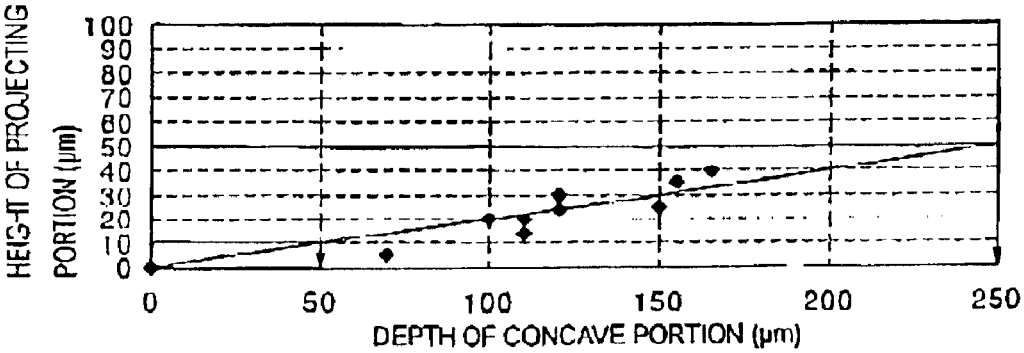
FIG. 8 is a graph showing a relationship between the height of the return portion and the depth of the concave portion of the valve plate.

Also, when the depth D of the concave portions 45 from the surface of the valve plate 9 was measured, it was found that the depth D was in the mutual relationship with the height H of the return portions 46 as shown in FIG. 8. From FIG. 8, it is appreciated that the depth D corresponding to the height H of 10 to 50 $\mu$m of the return portions 46 is in the range of 50 to 250 $\mu$m and if this depth may be kept, it is possible to sufficiently keep the retaining function of the lubricant oil.

Furthermore, Fe material having a hardness Hv of about 90 to 200 is the most suitable as the material of the valve plate 9. The lower limit of the hardness is determined in consideration of the wear-resistance of the return portions 46 and the upper limit is determined in consideration of the service life of the punch die 43, respectively. In this case, it is the optimum condition that the height H of the return portions 46 be in the range of 25 to 35 $\mu$m and the depth of the concave portions 45 be in the range of about 120 to 170 $\mu$m. Also, it is the optimum condition that the pitch P be in the range of about 0.5 to 1.0 mm in view of the separating performance of the reed portions, the manufacturing property of the punch die 43 and the like.

Since the roughened region 31 is formed by the pressing of the punch die 43, there is no generation of process scraps or there is no residual shot grain on the surface of the valve plate 9. Also, since the convex and concave configuration of the tip end face 42 of the punch die 43 is transferred, the reproducibility of the convex and concave configuration is excellent in comparison with the roughening through the conventional shot blast method and it is easy to perform quality control with respect to this roughened region 31.

Also, since the roughened surface 31 is formed by the press, it is possible to form the roughened region 31 as a part of the press machining performed in the manufacture of the valve plate 9 to thereby simplify the manufacturing steps.

Figure 9:
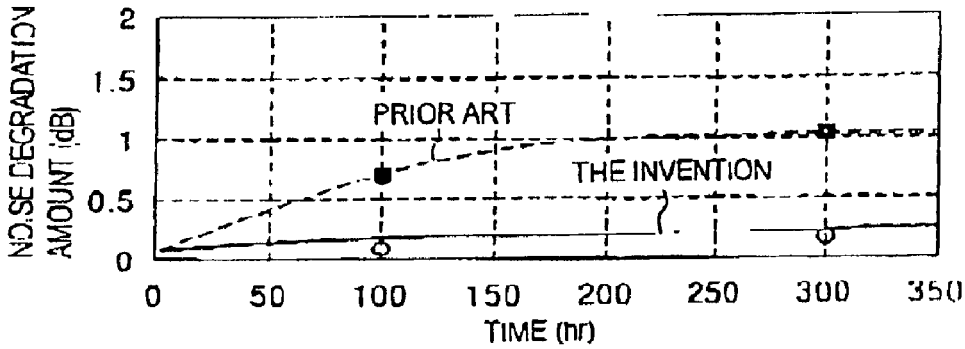
FIGS. 9 and 10 are graphs showing a noise degradation amount and a pulsation degradation amount of a compressor into which the valve plate manufactured in accordance with the embodiment has been incorporated, respectively.
Figure 10:
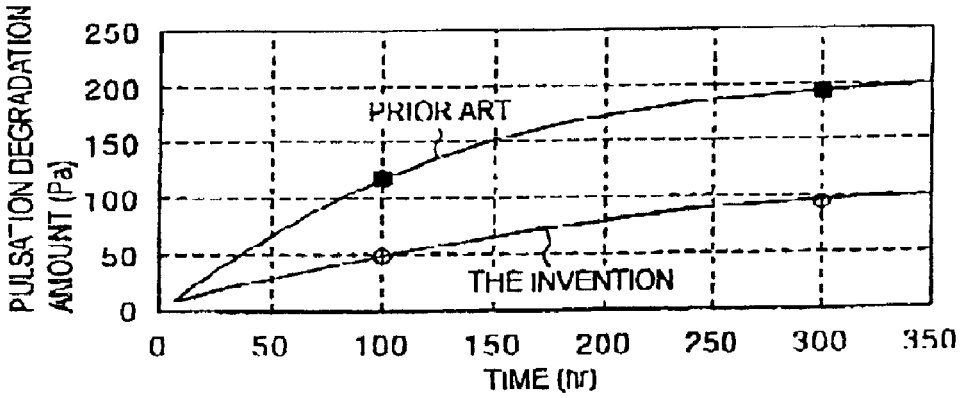

The valve plate 9 with the roughened region 31 having a hardness H of 25 $\mu$m of the return portions 46, a depth D of 120 $\mu$m and a pitch of 0.5 mm of the concave portions 45 was manufactured from the Fe material having a hardness Hv of 100 in accordance with the method of this embodiment, the compressor was assembled, and the noise degradation amount and the pulsation degradation amount were measured to the operation time. As a result, the results shown in FIGS. 9 and 10 were obtained, respectively. In FIGS. 9 and 10, for the purpose of comparison, the measured values in the compressor having the conventional valve plate whose surface is roughened by a shot blast method are described together. It is found that the noise degradation amount and the pulsation degradation amount are both considerably improved in comparison with the conventional case.

It is considered the reason for this is that the surface layer portion of the valve plate 9 is hardened in accordance with the press of the punch die 43 and the return portions 46 excellent in wear-resistance are formed in the roughened region so that the degradation amounts of the noise and the pulsation are reduced. Even if the return portions 46 are worn with the lapse of the operation time of the compressor, since the retaining function of the lubricant oil is maintained in the concave portions 45, there is no fear that the separating performance of the suction reed portion is abruptly degraded.

The convex portions 44 of the tip end face 42 of the punch die 43 are not limited to the square pyramid shape but it is possible to adopt a circular conical shape, a triangular pyramid shape or a polygonal pyramid shape with five corners or more. In order to facilitate the manufacture of the punch die, it is preferable to arrange the convex portions 44 uniformly, but the arrangement thereof is not limited thereto.

Furthermore, if plating or heat treatment is effected on the roughened region 31 of the valve plate 9 against which the punch die 43 has been pressed, the wear-resistance of the roughened region 31 is further enhanced. In the same manner, if plating or heat treatment is effected on the end face 42 of the punch die 43, the wear-resistance of the punch die 43 is further enhanced.

Figure 11:
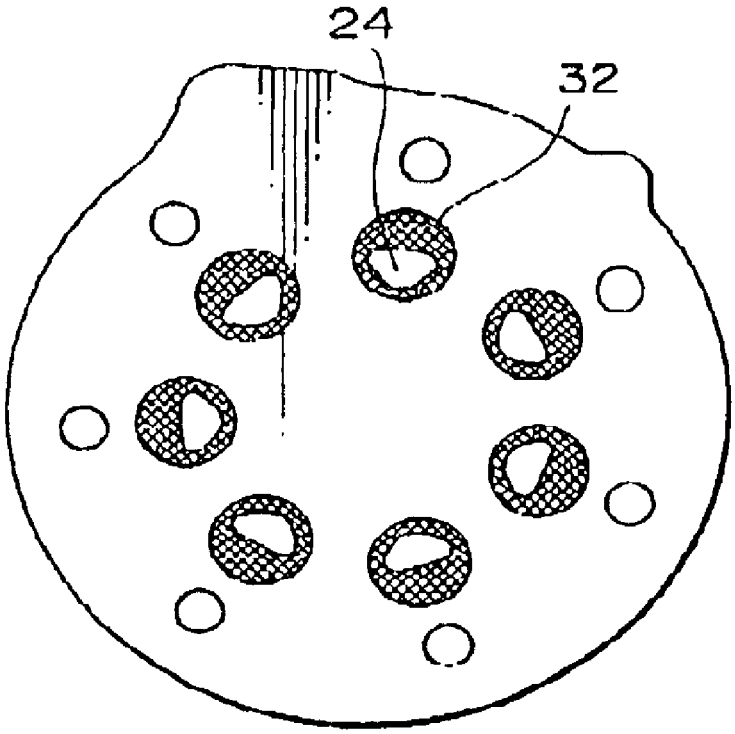
FIG. 11 is a plan view showing a valve plate manufactured in accordance with a manufacturing method of another embodiment.

Incidentally, although, in FIG. 2, the roughened region 31 is formed into a shape that fits for the opening shape of the suction port 24, the shape is not limited thereto. For example, as shown in FIG. 11, a simple circular roughened region 32 may be formed to thereby simplify the shape of the punch die 43 and it is easy to manufacture the punch die 43.

Also, in the same manner, it is also possible to form the roughened surface around the discharge port 25 of the valve plate 9. Furthermore, it is possible to form the roughened regions on both the peripheral portions of the suction port 24 and the discharge port 25.

As described above, according to this invention, since the punch die with its tip end face of the concave and convex configuration is pressed to thereby roughen the peripheral portion of the suction port or discharge port of the valve plate, there is no generation of process scraps, and since shot grains are not used, the remaining of foreign matter on the surface of the valve plate can be suppressed. Accordingly, the quality of the valve plate is enhanced and operational failure or breakdown of the compressor due to the intrusion of the foreign matter thereinto accompanying the surface roughening operation can be prevented.

Also, it is easy to execute quality control of the valve plate because of the excellent reproducibility of the roughened surface.

Furthermore, since the surface roughening operation may be performed as a part of the press machining, it is possible to simplify the manufacturing process of the valve plate.

What is claimed is:

1. A method of manufacturing a valve plate for a compressor which divides a suction chamber and a discharge chamber from a cylinder block, said method comprising the steps of:

forming in the plate at least one suction port and at least one discharge port; and pressing a punch die with a tip end face having a plurality of fine pyramid-shaped convex portions arranged at a pitch between about 0.5 mm and 1.0 mm, against at least one of a peripheral portion of each suction port with which a reed portion of a suction valve is brought into contacts, and a peripheral portion of each discharge port with which a reed portion of a discharge valve is brought into contact, the punch die forming, through said pressing, a roughened surface on the at least one peripheral portion, the roughened surface having concave portions and return portions projecting from and formed in peripheral edges of said concave portions, a height of the return portions being between about 10 and 50 $\mu$m, and a depth of the concave portions being between about 50 and 250.

2. A method according to claim 1 wherein the tip end face configuration of the punch die is transferred onto both peripheral portions of the suction port and the discharge port.

3. A method according to claim 1 wherein a formation of the suction port and the discharge port and the roughening of the peripheral portions thereof are performed during a common press machining process.

4. A method according to claim 1 wherein the plate is made of Fe material having a hardness Hv of 90 to 200.

* * * * *

UNITED STATES PATENT AND TRADEMARK OFFICE

CERTIFICATE OF CORRECTION

PATENT NO. : 6,912,783 B2
DATED : July 5, 2005
INVENTOR(S) : Tanaka et al.

It is certified that error appears in the above-identified patent and that said Letters Patent is hereby corrected as shown below:

Title page,
Item [54], delete the title in its entirety and insert therefore:
-- METHOD OF MANUFACTURING A VALVE PLATE FOR A COMPRESSOR --.

Column 6,
Line 38, please delete "into contacts," and insert therefore -- into contact, --.
Line 47, please delete "250." and insert therefore -- 250 $\mu$m. --.

Signed and Sealed this

Sixth Day of September, 2005

JON W. DUDAS
*Director of the United States Patent and Trademark Office*